US009777910B2

(12) United States Patent
Hunt, III et al.

(10) Patent No.: US 9,777,910 B2
(45) Date of Patent: Oct. 3, 2017

(54) LED BASED AREA LIGHTING FIXTURE

(71) Applicant: Atlas Lighting Products, Inc., Burlington, NC (US)

(72) Inventors: R. Samuel Hunt, III, Burlington, NC (US); James H. Bennett, Greensboro, NC (US); Scott T. Ellingson, Graham, NC (US); Cheng S. Chang, Elon, NC (US)

(73) Assignee: Atlas Lighting Products, Inc., Burlington, NC (US)

( * ) Notice: Subject to any disclaimer, the term of this patent is extended or adjusted under 35 U.S.C. 154(b) by 232 days.

(21) Appl. No.: 14/666,382

(22) Filed: Mar. 24, 2015

(65) Prior Publication Data

US 2016/0281967 A1 Sep. 29, 2016

(51) Int. Cl.
*F21V 7/00* (2006.01)
*F21V 21/116* (2006.01)
(Continued)

(52) U.S. Cl.
CPC ..... *F21V 21/116* (2013.01); *F21S 8/086* (2013.01); *F21V 23/009* (2013.01); *F21V 29/15* (2015.01);
(Continued)

(58) Field of Classification Search
CPC ..... F21V 21/116; F21V 21/08; F21V 21/088; F21V 21/0832; F21V 21/002; F21V 21/02; F21V 21/108; F21V 23/009; F21V 29/15; F21V 99/00; F21V 19/00; F21K 99/00; F21S 8/086; F21S 8/036; F21S 8/043; F21S 8/033; F21S 8/108; F21S 8/116; F21S 8/08; F21S 8/088; F21S 13/10; F21W 2131/103; F21Y 2115/10; F21Y 2105/10
(Continued)

(56) References Cited

U.S. PATENT DOCUMENTS 3,986,019 A 10/1976 deVos, et al.
4,793,581 A * 12/1988 Bilson ..... F21V 21/116 248/218.4
(Continued)

OTHER PUBLICATIONS

Lithonia Universal Mounting Bracket, http://antiquestreetlamps.acuitybrands.com/-/media/products/lithonia_lighting/209327/document/universal-mounting-bracket-sell-sheet_pdf.pdf, known at least as early as Mar. 23, 2015, last viewed Jul. 14, 2015, 2 pgs.
(Continued)

*Primary Examiner* — Elmito Breval
*Assistant Examiner* — Omar Rojas Cadima
(74) *Attorney, Agent, or Firm* — Womble Carlyle Sandridge & Rice, LLP

(57) ABSTRACT

An LED light fixture includes an integrally formed unitary housing having a first portion and second portion laterally adjacent to one another. The first and second portions at least partially define separate illuminating and wiring compartments. The illuminating compartment houses a plurality of light emitting diodes and a reflector. The illuminating compartment is partially defined by a frame and a lens mounted to the first portion of the housing. The wiring compartment has at least one wall defined by a door. The door is pivotably attached to the housing. A driver for the plurality of light emitting diodes is mounted to the door for movement with the door.

17 Claims, 12 Drawing Sheets

(51) Int. Cl.

| | |
|---|---|
| ***F21V 23/00*** | (2015.01) |
| ***F21S 8/08*** | (2006.01) |
| ***F21V 29/15*** | (2015.01) |
| *F21W 131/103* | (2006.01) |
| *F21Y 105/10* | (2016.01) |
| *F21Y 115/10* | (2016.01) |

(52) U.S. Cl.
CPC .... *F21W 2131/103* (2013.01); *F21Y 2105/10* (2016.08); *F21Y 2115/10* (2016.08)

(58) Field of Classification Search
USPC ..... 362/296.01, 368, 376, 396, 432, 457, 362/458, 153.1, 370, 410, 431
See application file for complete search history.

(56) References Cited

U.S. PATENT DOCUMENTS

| | | | | |
|---|---|---|---|---|
| D531,342 | S | 10/2006 | Kauffman et al. | |
| D556,935 | S | 12/2007 | Quioque et al. | |
| D609,384 | S | 2/2010 | Gray et al. | |
| D614,336 | S | 4/2010 | Zheng, et al. | |
| D615,690 | S | 5/2010 | Zheng, et al. | |
| 7,758,211 | B2 | 7/2010 | Zheng, et al. | |
| 7,794,116 | B2 | 9/2010 | Shuai, et al. | |
| 7,841,755 | B1 | 11/2010 | Walker | |
| D632,007 | S | 2/2011 | Kim, et al. | |
| D634,875 | S | 3/2011 | Jiang, et al. | |
| D641,908 | S | 7/2011 | McKee | |
| D643,958 | S | 8/2011 | Lin et al. | |
| 8,070,306 | B2 | 12/2011 | Ruud et al. | |
| D652,557 | S | 1/2012 | Boissevain et al. | |
| D652,978 | S | 1/2012 | Boissevain et al. | |
| D662,244 | S | 6/2012 | Chen et al. | |
| D668,370 | S | 10/2012 | Guercio et al. | |
| 8,342,709 | B2 | 1/2013 | Lueken et al. | |
| D676,177 | S | 2/2013 | Akinrele et al. | |
| D695,437 | S | 12/2013 | Johnson et al. | |
| 8,708,526 | B2 | 4/2014 | Wu | |
| 8,783,917 | B2 | 7/2014 | Mrakovich | |
| D713,583 | S | 9/2014 | Yu | |
| 8,851,711 | B2 | 10/2014 | Ladewig et al. | |
| D717,989 | S | 11/2014 | Heim et al. | |
| D721,844 | S | 1/2015 | Lay et al. | |
| D726,947 | S | 4/2015 | Boyer et al. | |
| D736,983 | S | 8/2015 | Dal Ponte et al. | |
| 2011/0187270 | A1 | 8/2011 | Summerford et al. | |
| 2012/0236560 | A1* | 9/2012 | Bosch | F21S 8/088 362/240 |
| 2013/0188371 | A1* | 7/2013 | Ham, II | F21V 29/20 362/373 |
| 2014/0153242 | A1 | 6/2014 | Ruud et al. | |
| 2014/0218941 | A1 | 8/2014 | Wilcox et al. | |
| 2015/0043200 | A1* | 2/2015 | Wilson | F21S 9/035 362/145 |

OTHER PUBLICATIONS

LSI Industries, LED Area Lights—LSI Slice (XLCS, XLCM), http://www.lsi-industries.com/products/led_arealights_slice-xlcs.xlcm.aspx, known at least as early as Mar. 24, 2015, 1 pg.

Visionaire Lighting, LED Luminaire Product Overview, http://visionairelighting.com/productDetails.asp?productID=457, known at least as early as Mar. 24, 2015, 2 pgs.

Cree OSQ Series LED Flood Luminaire, http://www.cree.com/Lighting/Products/Outdoor/Flood/OSQ-Series, known at least as early as Mar. 24, 2015, 1 pg.

Lithonia Lighting, the Best Value in Lighting, http://www.lithonia.com/, known at least as early as Mar. 24, 2015, 4 pgs.

Philips Gardco, Classic Gullwing Shape, LED Performance, 18" Gullwing LED Area and Roadway Luminaire brochure, 2013, 12 pgs.

Philips Gardco PureForm, LED Solution, Pure in Form and Function Defining Performance, Specification Grade Luminaires brochure, 2014, 24 pgs.

GE Lighting, Evolve LED Area Light N Series (EANA) brochure, Feb. 6, 2015, 8 pgs.

VLX LED Luminaire, Visionaire Lighting brochure, known at least as early as Mar. 24, 2015, 16 pgs.

GE Evolve LED Scalable Area Light Fixtures, http://www.gelighting.com/LightingWeb/na/solutions/outdoor-lighting/area-and-site/ . . . , Jan. 29, 2015, 2 pgs.

GE Lighting, Area Lighting, Outdoor Lighting, http://www.gelighting.com/LightingWeb/na/solutions/outdoor-lighting/area-and-site/, Jan. 29, 2015, 3 pgs.

RAB Lighting, ALED2T150, http://www.rabweb.com/product.php?product=ALED2T150, Jan. 29, 2015, 2 pgs.

Cooper Lighting, Area/Site Lighting, http://www.cooperindustries.com/content/public/en/lighting/products/area_site_lighting.html, Jan. 29, 2015, 15 pgs.

Lithonia Lighting, Outdoor Area Lighting, http://www.lithonia.com/pt/outdoor/c/area+lighting/, known at least as early as Mar. 24, 2015, 3 pgs.

Cree Lighting Outdoor Products, http://www.cree.com/Lighting/Products/Outdoor, Jan. 29, 2015, 3 pgs.

* cited by examiner

LED BASED AREA LIGHTING FIXTURE

FIELD OF INVENTION

The present invention is directed toward light fixtures that emit light through the use of light emitting diodes. Particularly, the present invention is directed toward flood type lighting fixtures used for illuminating large areas, such as parking lots and streets.

BACKGROUND

Businesses and property owners rely upon light fixtures to illuminate their parking lots and other property. Providing illumination to these areas enhances the safety, security, utility, and general aesthetics of the area at night. At the same time, these users are looking to save money by reducing their energy costs with the use of more energy efficient light fixtures.

More and more fixtures that rely upon high-intensity discharge lamps (HID), or other high consumption light emitters, are being replaced by new fixtures that produce light through the use of light emitting diode (LED) technology.

As a result there continues to be a need for LED based area-lighting fixtures that provide an improved balance of energy efficiency, heat dissipation, distribution pattern, aesthetics, and installer convenience.

SUMMARY

Embodiments of the present disclosure include LED light fixtures that can have an integrally formed unitary housing having a first portion and second portion laterally adjacent to one another. The first and second portions at least partially define separate illuminating and wiring compartments. The illuminating compartment houses a plurality of light emitting diodes and a reflector. The illuminating compartment is partially defined by a frame and a lens mounted to the first portion of the housing. The wiring compartment has at least one wall defined by a door. The door is pivotably attached to the housing. A driver for the plurality of light emitting diodes is mounted to the door for movement with the door.

Embodiments of the present disclosure also include LED light fixtures that can have an integrally formed unitary housing having a first portion and second portion laterally adjacent to one another. The first and second portions at least partially define separate illuminating and wiring compartments. The illuminating compartment houses a plurality of light emitting diodes and a reflector. The illuminating compartment is partially defined by a frame and a lens mounted to the first portion of the housing. The second portion of the housing can have an elongated body with a first end opposite the first portion and a second end joining with the first portion. The second portion may provide a mounting arm for mounting the light fixture to a pole at the first end. The fixture may further comprise a mounting bracket configured to be attached to the pole, the first end configured to slide over the mounting bracket to secure the housing to the pole.

Embodiments of the present disclosure also include a method of installing a light fixture to a pole. The method includes providing an LED light fixture comprising an integrally formed unitary housing having a first portion and second portion laterally adjacent to one another. The first and second portions define separate illuminating and wiring compartments. The illuminating compartment at least partially contains a plurality of light emitting diodes and a reflector. The illuminating compartment may be partially defined by a frame and a lens mounted to the first portion of the housing. The second portion of the housing may have an elongated body with a first end distal from the first portion and a second end joining with the first portion. The second portion may provide a mounting arm for mounting the light fixture to a pole at the first end. The method may also include the step of mounting a bracket to the pole at a desired height, the step of sliding the first end of the housing over the mounting bracket, and the step of fastening the housing to the bracket.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed

BRIEF DESCRIPTION OF THE DRAWINGS

The foregoing and still other objects and advantages of the present invention will be more apparent from the following detailed explanation of embodiments of the invention in connection with the accompanying drawings.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
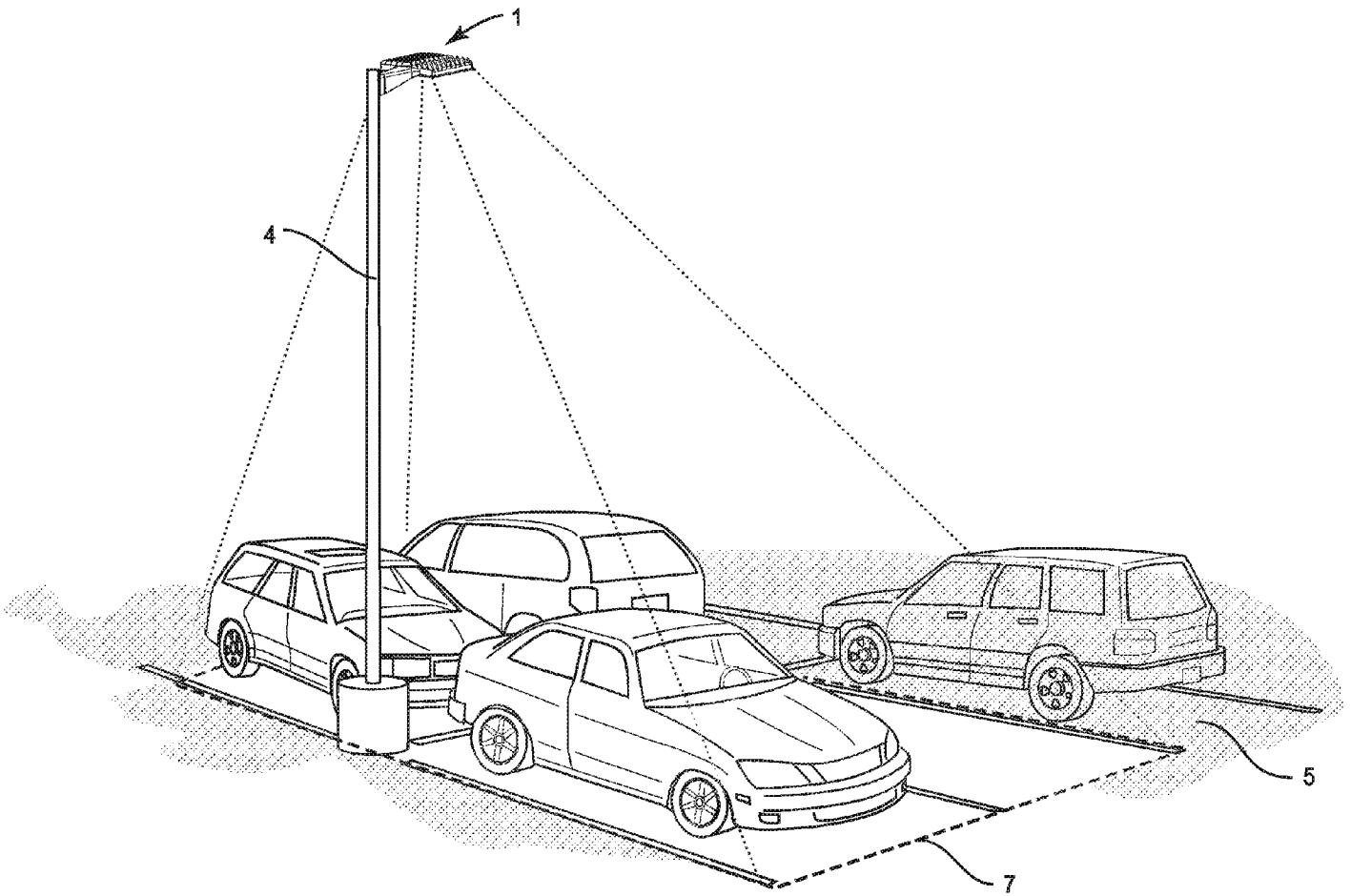
FIG. 1 shows a fixture according to embodiments of the present invention in an environmental view.
Figure 2:
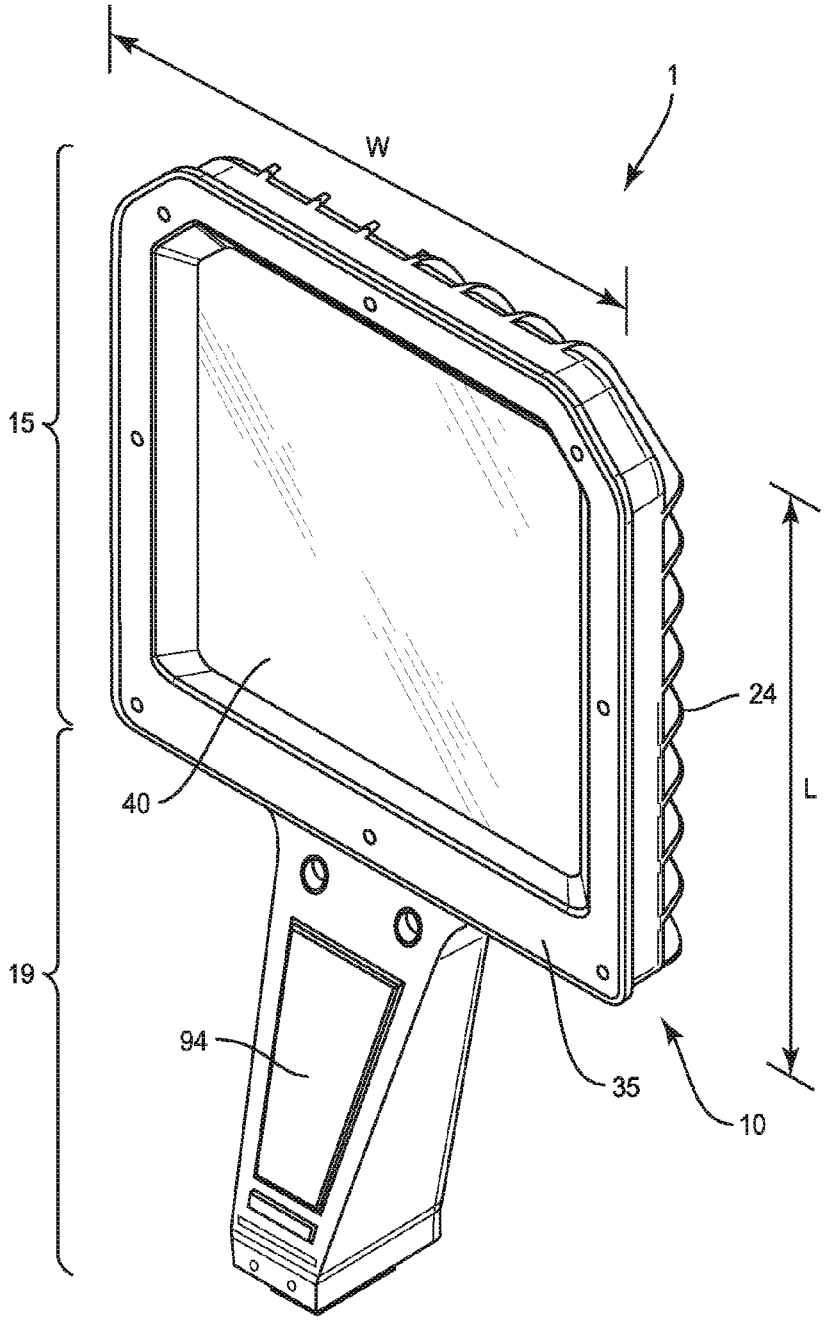
FIG. 2 is a bottom front perspective view of a fixture according to embodiments of the present disclosure.
Figure 3:
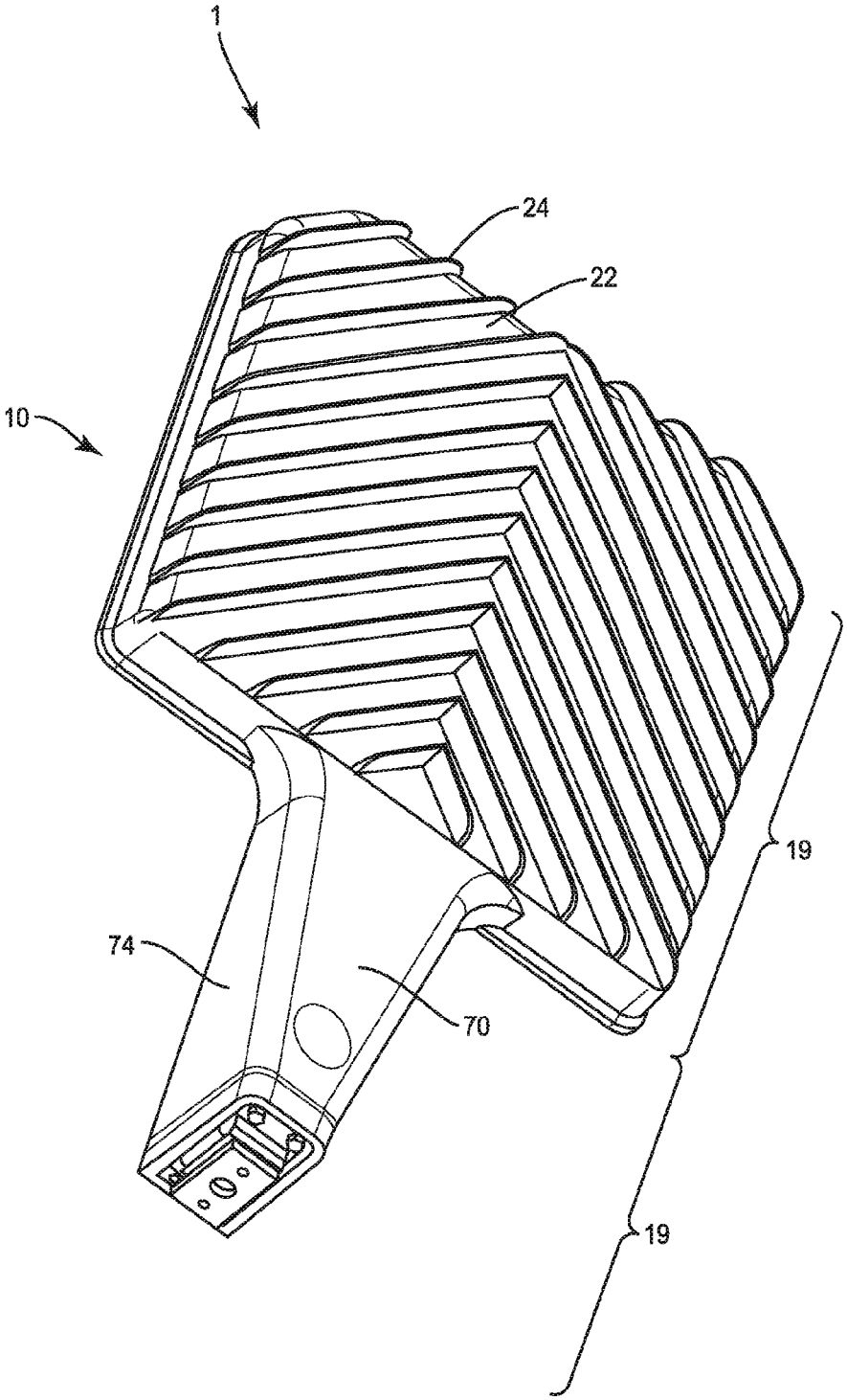
FIG. 3 is a top rear perspective view of the fixture of FIG. 2.
Figure 4:
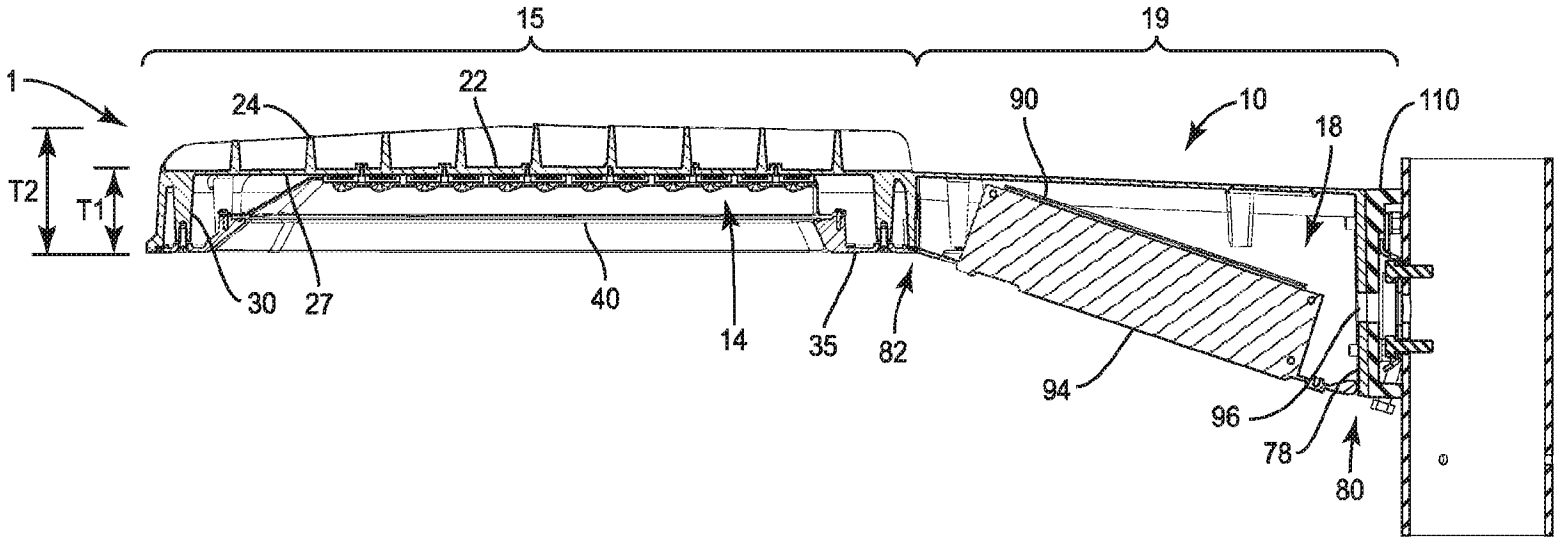
FIG. 4 is a cross sectional view of the fixture of FIG. 2 along section II-II.
Figure 5:
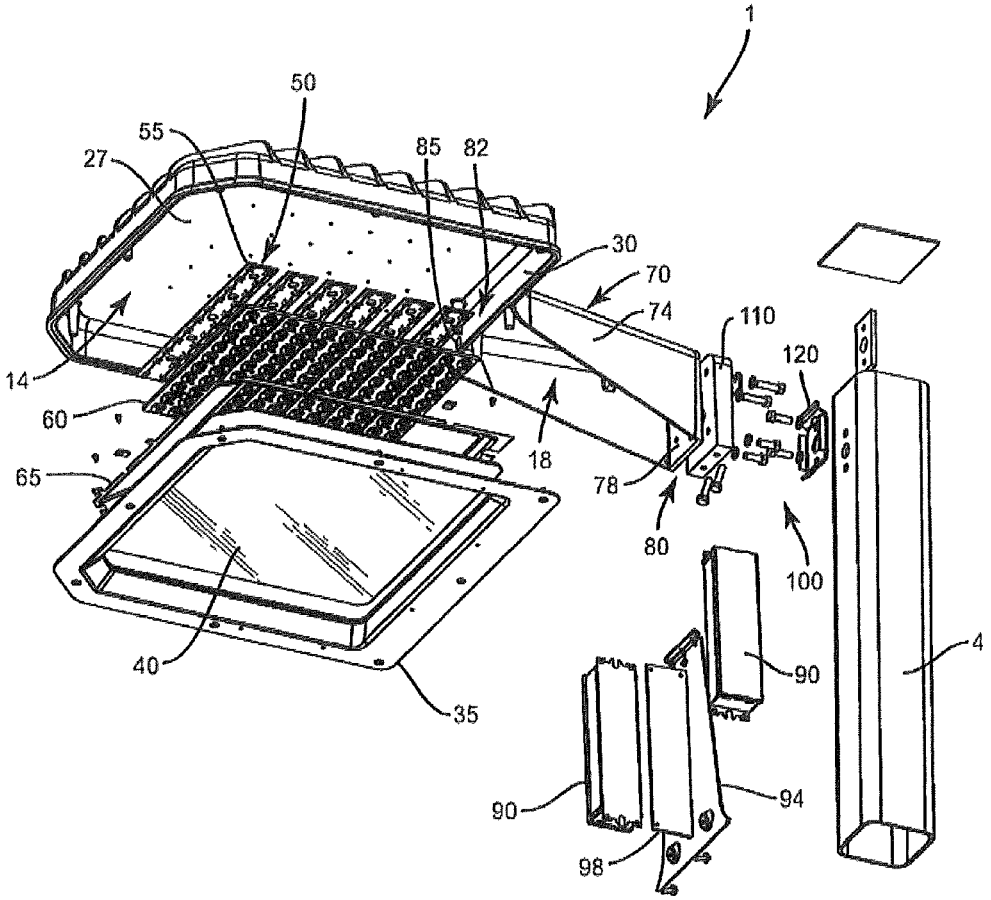
FIG. 5 is an exploded view of the fixture from the bottom.
Figure 6:
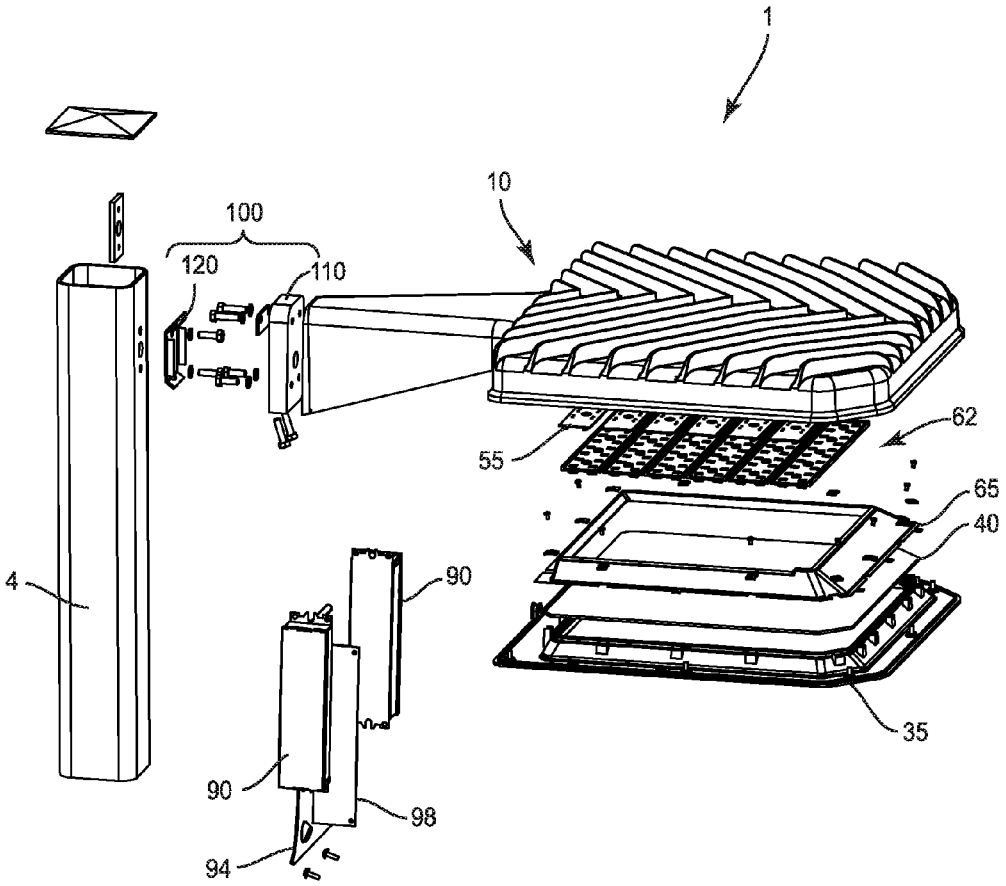
FIG. 6 shows an exploded view of the fixture from the top.

Turning to the figures, FIG. 1 shows a light fixture 1 according to embodiments of the present disclosure. The light fixture 1 may be mounted high upon a pole 4, potentially as high as one to several stories above a parking lot 5 or other terrain to be illuminated. The light fixture 1 can be configured to provide a distribution pattern 7 on the terrain. The light fixture 1, particularly the internal elements thereof, may be configured such that the light fixture 1 may be constructed to provide the distribution pattern 7 according to one or more of the standard distribution patterns (Types I-V) as is known in the art according to the Illuminating Engineering Society's "The Lighting Handbook".

The details and construction of the light fixture 1 will be clearer in view of FIGS. 2-6. The light fixture 1 includes a housing 10 at least partially defining an illuminating compartment 14 within a first portion 15 of the housing 10. A wiring compartment 18 is at least partially defined within a second portion 19 of the housing 10 laterally adjacent to the first portion 15. In a preferred embodiment, the housing 10 is cast to form an integral, unitary housing construction. In another embodiment, the housing 10 could be in the form of several pieces joined together. The housing 10 should be constructed from a material that will readily conduct heat. In one embodiment, the housing 10 is cast from aluminum, but other materials may be used. While the housing 10 may be cast, other methods of forming the housing 10, such as machining, injection molding or additive manufacturing may be used.

The first portion 15 includes an outer surface 22 with a plurality of fins 24 extending from the outer surface 22. It should be understood that the fins 24 may be cast as part of the housing 10. The fins 24 increase the exposed surface area of the housing 10 to increase dissipation of heat from within the housing 10. The first portion 15 also includes an inner surface 27. The inner surface 27 is surrounded by a peripheral wall 30. Therefore, the illuminating compartment 14 is partially defined by the inner surface 27 and the peripheral wall 30.

The illuminating compartment 14 may be further defined by a frame 35 mounted to the peripheral wall 30 at a location opposite the inner surface 27. The frame 35 is configured to support a lens 40 that substantially completes the enclosure of the illuminating compartment 14. The lens 40 may be made from glass or polymer. The lens 40 may be transparent. In other embodiments, the lens 40 may have a material or a surface profile, such as prisms, rendering the lens 40 translucent or otherwise light diffusive.

The first portion 15 of housing 10 can generally rectangular in shape with a relatively thin profile. The first portion 15 may be defined by a first thickness T1 from the lens 40 to the inner surface 27. T1 may be between about one inch and about two inches. A second thickness T2 from the lens 40 to the tips of the fins 24 may be between about two inches and about 4 inches. The first portion 15 may also include a length L and a width W. In one embodiment, the first portion may be between about twelve inches and about eighteen inches on each side. The relatively thin profile of the first portion 15 can be defined as the ratio of housing area L×W to housing thickness T1 or T2. In one embodiment the ratio with respect to T1 is greater than seventy-five and the ratio with respect to T2 is greater than thirty-six.

Within the illuminating compartment 14 may reside an array of light emitting diodes (LEDs) 50 mounted on one or more circuit boards 55, a plurality of LED optics 60, and a reflector 65. The quantity, power and arrangement of the LEDs 50 within the array may vary based upon the desired brightness and energy consumption of the light fixture 1.

The array of LEDs 50 may be disposed on a single circuit board, or a plurality of circuit boards 55 as shown in the figures. Use of a plurality of circuit boards 55 may reduce maintenance and replacement costs because only some, and not all, of the LEDs 50 in the array could be replaced at one time. The circuit boards 55 are preferably metal core or metal backed boards selected for their ability to dissipate heat. In some embodiments the rear surface of each circuit board 55 is coupled with the inner surface 27 of the illuminating compartment 14. The circuit boards 55 may be preferably coupled to the surface with thermal grease or thermal glue to maximize the area of conductive contact for maximum thermal dissipation.

The plurality of LED optics 60 are selected to provide a predetermined illumination pattern, or beam spread, for each LED 50. The individual emission patterns then combine to produce the desired distribution pattern 7 from the light fixture 1. The optics 60 may be individually applied to each led 50. Alternatively, as shown in the figures, a plurality of optics 60 may be molded or otherwise provided as a module over the whole or parts of the array of LEDs 50. In some embodiments, each LED optic 60 can be substantially identical, i.e. providing the same distribution from each LED 50. In other embodiments, the LED optics 60 may include a first set of optics providing a first distribution from their respective LEDs 50, and at least a second set of optics providing at least a second distribution from their respective LEDs 50. The arrangement of LEDs with optics from the first set relative to LEDs with optics from the second set may vary to further allow for customization of the distribution pattern 7, including both standard types I-V or other unique patterns based on the shape and use of the area to be illuminated.

In some embodiments, the optics 60 are provided in modules 62. The individual optics 60 may be integrally formed as part of the module 62. Alternatively, the module 62 may be provided by a holder having individually replaceable optics 60. In some embodiments, the optic modules 62 are mounted to the inner surface 27 with fasteners. The optic modules 62 may sandwich the circuit boards 55 against the inner surface 27 such that the circuit boards do not have to be independently fixed to the inner surface 27.

In the illustrated embodiment, a reflector 65 is disposed around the array of LEDs 50 and adjacent to the peripheral wall 30. The reflector 65 may be joined to the frame 35, mounted to first portion 15 of the housing 10, or merely held in place between the frame 35 and the inner surface 27. The reflector 65 has a reflecting wall 68. The reflector 65 is mounted within the illuminating compartment 14 such that the reflecting wall 68 forms an angle with the inner surface 27 approximately equal to the angle that light is emitted to the optics 60 adjacent to the reflector 65. This configuration minimizes the amount of light that bounces around within the illuminating compartment 14 and maximizes the light emitted into the distribution pattern 7.

Turning to the second portion 19 of the housing 10, the second portion 19 can provide a dual function. First, the second portion 19 at least partially defines the wiring compartment 18. Second, the second portion 19 is a generally elongated body to provide a mounting arm that positions the illuminating compartment 14 away from the pole 4. The wiring compartment 18 is defined in part by a top wall 70, side walls 74 and an end wall 78. The end wall 78 provides a first end 80 of the second portion 19 opposite the first portion 15. A second end 82 of the second portion 19 joins with the first portion 15. The second end 82 includes a slot, groove, or other passage 85 for passing conductors that provide electrical connection between the array of LEDs 50 within the illuminating compartment 14 and one or more driver 90 configured to reside within the wiring compartment 18.

The driver 90 may take any number of forms known in the art so long as the driver 90 converts source power, such as received from the electric grid, to a proper current and voltage for use by the array of LEDs 50. The term "driver" as used herein is provided in a general sense for any means of properly powering the array of LEDs 50. Therefore the driver 90 may include control circuitry to regulate current, regulate voltage, provide surge protection, act as a timer for turning on and off the fixtures, or include sensors for controlling when the LEDs of the fixture are on or off.

One advantage of the light fixture 1 is an improved ease of installation and maintenance. Unlike much of the prior parking lot fixtures or street lights require two people to install. The present light fixture 1 has been designed to facilitate installation by one person.

Figure 7:
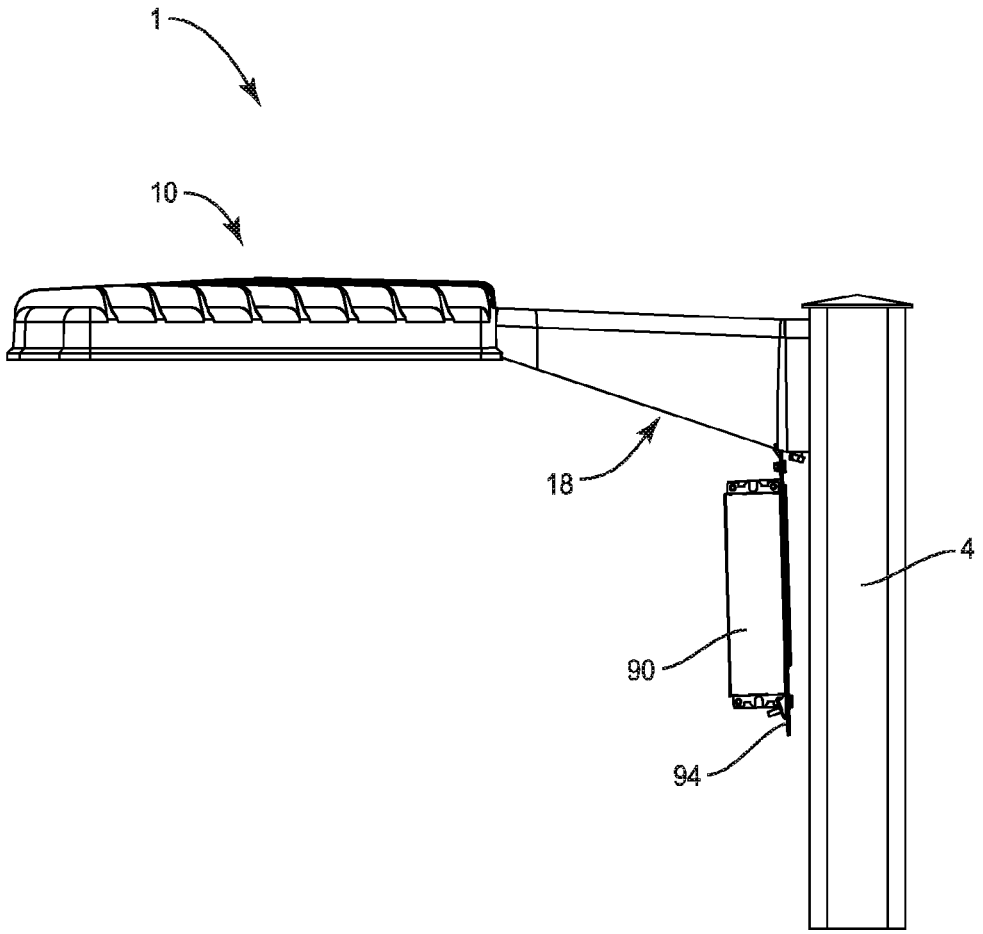
FIG. 7 is a side view of the fixture with the wiring compartment open.

One aspect of the improved installation is provided by the accessibility of the wiring compartment 18 and the one or more driver 90. Particularly, the driver 90 is mounted to a door 94 that is pivotably connected to the second portion 19 of the housing 10 to define the remaining wall of the wiring compartment 18. The door 94 is therefore able to move with the door 94 to pivot between a closed position enclosing the wiring compartment 18 and an open position hanging below the wiring compartment 18 as shown in FIG. 7. The open position of the door 94 exposes the driver 90 at a location below the housing 10 for free access thereto. With the driver 90 removed from within the wiring compartment 18 when the door 94 is open, the space within the wiring compartment 18 is available for access by the installer as they route source wires from the pole 4 into the housing 10 via an aperture 96 in the end wall 78. The source wires from the pole 4 are then electrically connected with the driver 90.

In some embodiments, a heat sink 98 may be mounted to the door 94 adjacent to the driver 90, or between separate drivers. Providing the driver 90 remote from the illuminating compartment 14 minimizes how much the LEDs heat the driver 90, and vice versa, to avoid buildup of excess temperatures within the housing 10 that can lead to premature failure of the electrical components.

Another aspect of the improved installation facilitated by the present light fixture 1 is provided by the mounting system 100 best understood from FIGS. 8-11. The mounting system 100 comprises an adaptor 110 and a mounting bracket 120 to allow the housing 10 to slidably attach to the pole 4.

Figure 8:
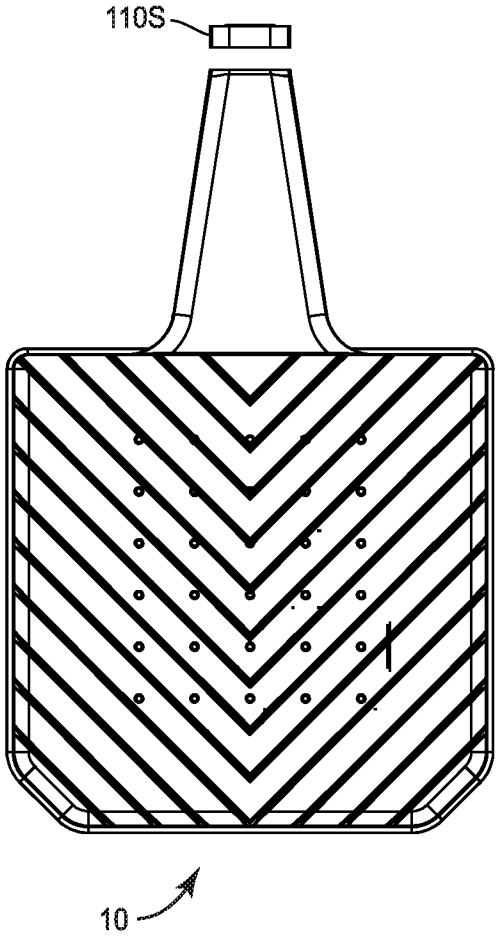
FIG. 8 shows alternative mounting configurations for the fixture.
Figure 8:
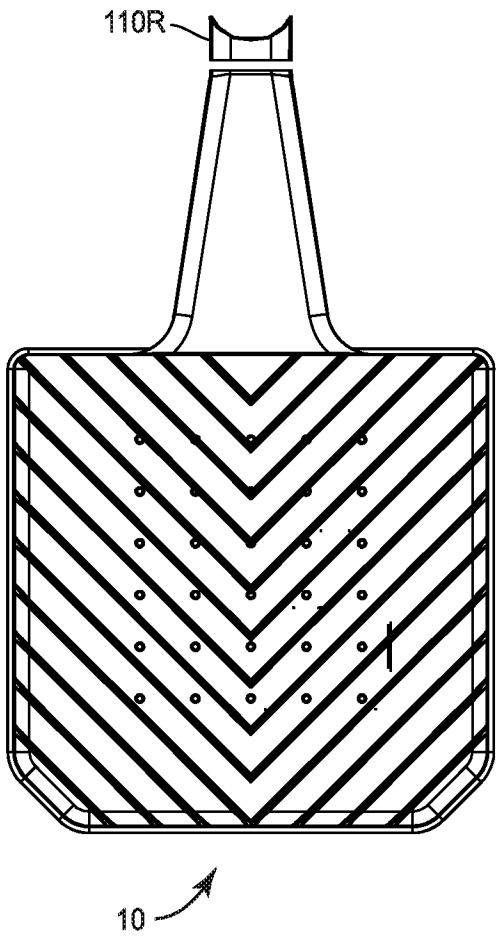
Figure 9:
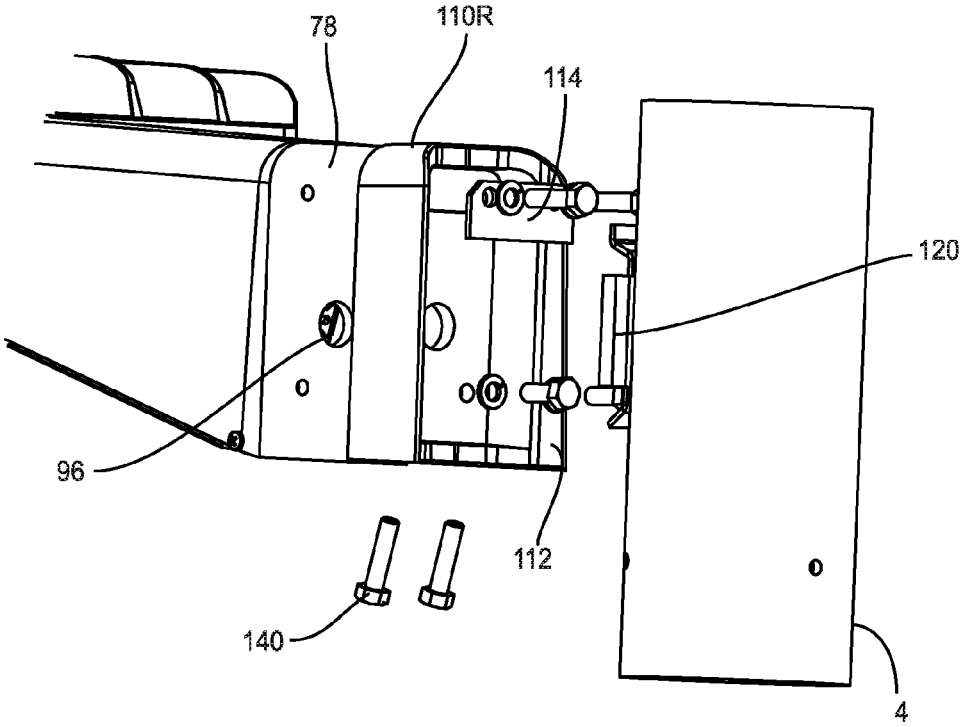
FIG. 9 shows a round pole adaptor according to embodiments of the present invention.

The adaptor 110 is mounted to the end wall 78 of the housing 10 by a plurality of fasteners, such as nuts and bolts. The adaptor 110 is selected based on the configuration of the pole 4 upon which the light fixture 1 will be mounted. FIG. 8 shows a round pole adaptor 110R and a square pole adaptor 110S. As should be understood, the pole-side wall 112 of the adaptor 110 is contoured to substantially follow the exterior surface of the pole 4. As best seen in FIG. 9, the adaptor 110 includes a lip 114 adjacent to the pole-side wall 112 configured to engage with the mounting bracket 120. The lip 114 may be cast as part of the adaptor 110 or separately secured thereto.

Figure 10:
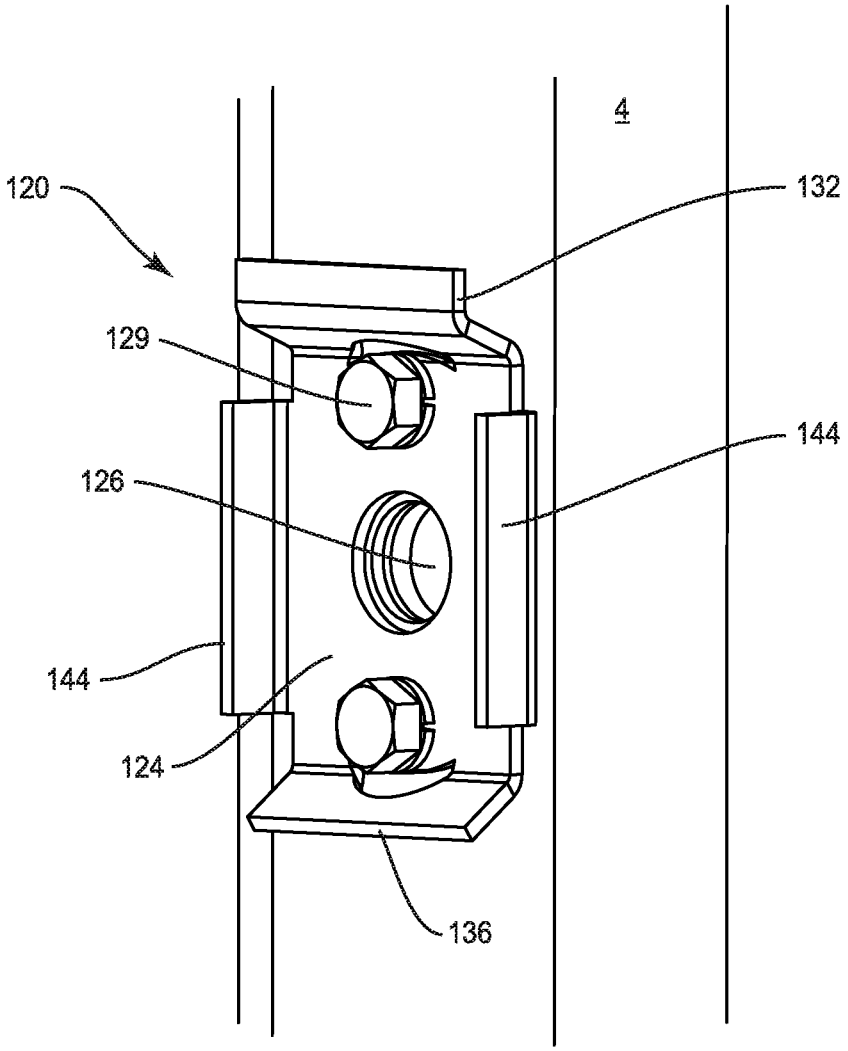
FIG. 10 shows a mounting bracket according to embodiments of the present invention.

As best seen in FIG. 10, the mounting bracket 120 can include a base plate 124 having a wiring aperture 126 and a pair of attachment apertures 129 passing therethrough. A catch arm 132 extends outwardly and upwardly from the top of the base plate 124. The catch arm 132 is configured to engage with the lip 114. The angle of the catch arm 132 tends to bias the adaptor 110, and therefore the housing 10, in a direction toward the pole 4 for a secure fit. A fastening arm 136 may extend outwardly and downwardly from the bottom of the base plate 124. The fastening arm 136 is configured to mate with the end of a set screw 140 to further bias the adaptor 110 and the housing 10 toward the pole 4. The mounting bracket 120 may also include a pair of positioning flanges 144 extending outwardly from the side of the base plate 124 for centering the housing 10 with respect to the mounting bracket 120.

Figure 11A:
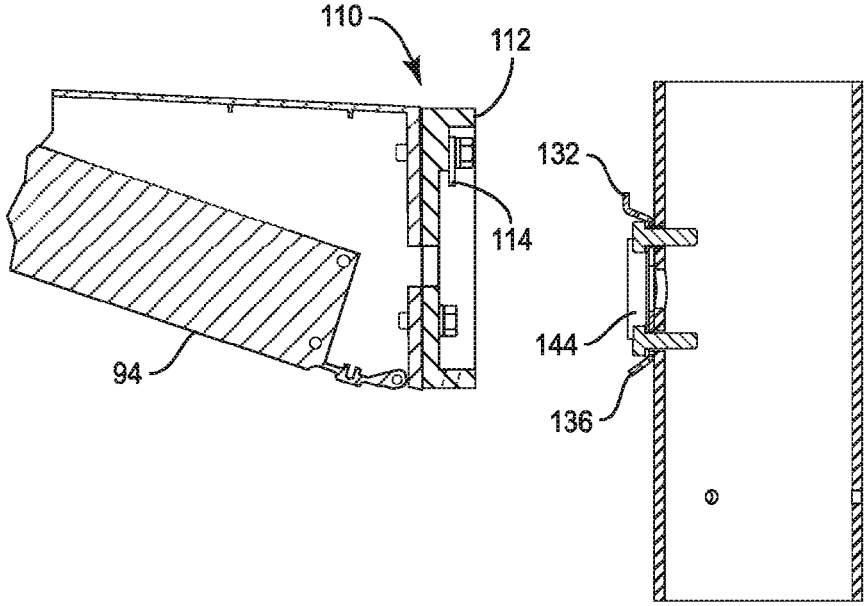
FIGS. 11A-11D show fixture mounting steps according to embodiments of the present invention.
Figure 11B:
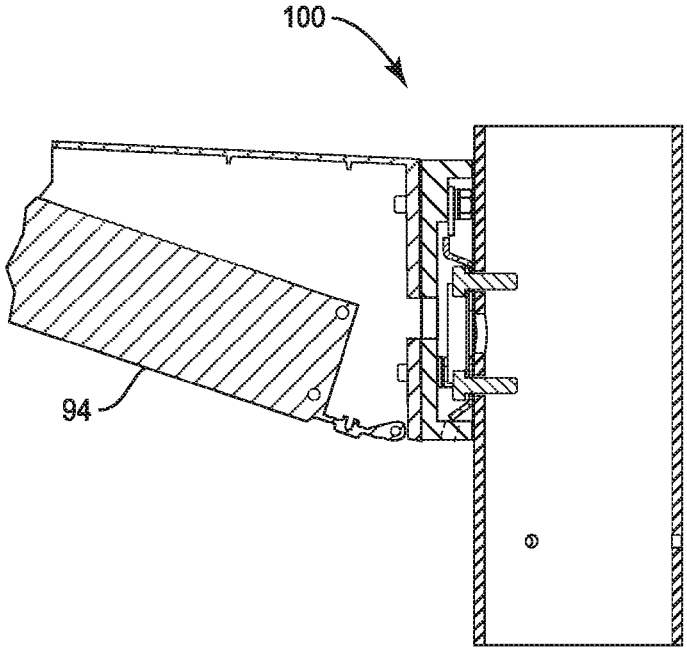
Figure 11C:
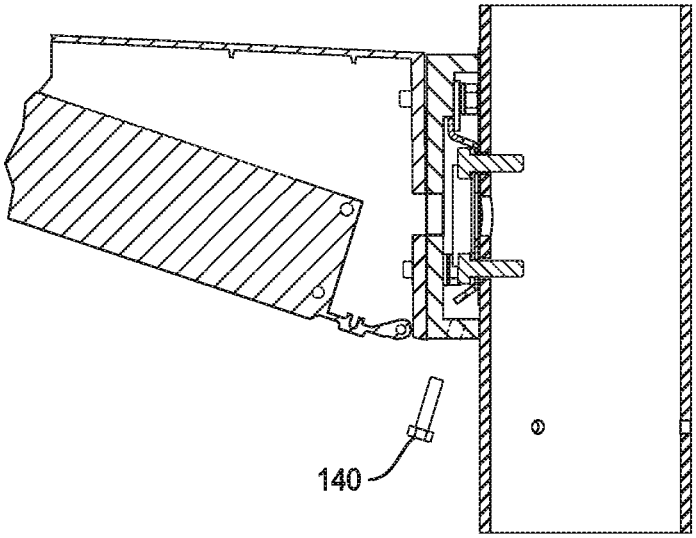
Figure 11D:
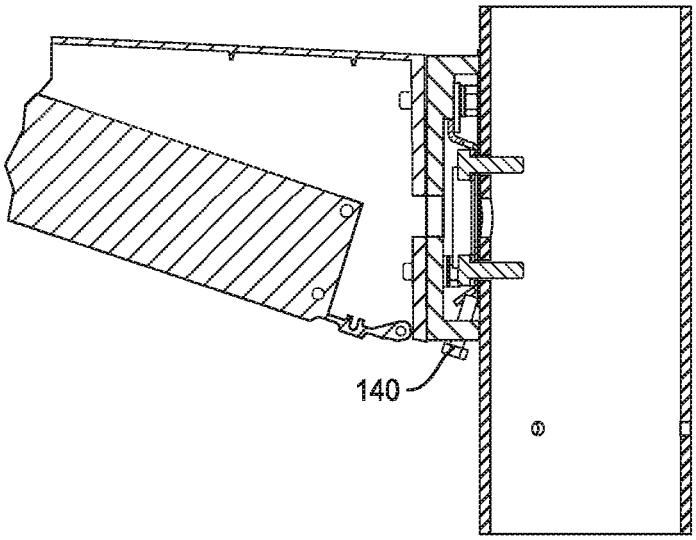

FIGS. 11A-11D illustrate the method of mounting the light fixture 1 to the pole 4. Initially, as shown in FIG. 11A, the adaptor 110 is provided on the housing 10 with fasteners, and the mounting bracket 120 is fastened to the pole 4 with additional fasteners passing though the attachment apertures 129. As shown in FIG. 11B, the adaptor 110 is centered above the mounting bracket 120 and substantially against the pole 4. The housing 10 and adaptor 110 are then slid down over the mounting bracket 120 to hook the lip 114 with the catch arm 132. The light fixture 1 may be secured in place by extending the set screw 140 through the adaptor 110 into secure contact with the fastening arm 136 such that the bottom of the adaptor 110 is drawn toward the pole 4 as shown in FIG. 11D.

In some embodiments of the mounting method, the source wires are accessed from within the pole 4 and led into the wiring compartment 18 between the steps shown in FIGS. 11A and 11B. The steps shown in FIGS. 11B and 11C may be performed while the door 94 is in the open position. Therefore, after initially attaching the light fixture 1 to the pole 4 in FIG. 11C, the source wires may be connected to the driver 90 while the door 94 is open. The door 94 would then be closed and the installation completed by fastening the set screw 140. In other embodiments the driver 90 may be electrically connected to the source wires after the fastening of the set screw 140.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. An LED light fixture comprising:

an integrally formed unitary housing having a first portion and second portion laterally adjacent to one another, the first and second portions at least partially defining separate illuminating and wiring compartments;

the illuminating compartment at least partially contains:

a plurality of light emitting diodes; and a reflector, the illuminating compartment being partially defined by a frame and a lens mounted to the first portion of the housing;

the wiring compartment has at least one wall defined by a door, the door being pivotably attached to the housing; and a driver for the plurality of light emitting diodes, the driver being mounted to the door for movement therewith, and configured to be received in the wiring compartment of the housing;

wherein the second portion of the housing has an elongated body with a first end opposite the first portion and a second end joining with the first portion, the second portion providing a mounting arm for mounting the light fixture to a vertical portion of a pole at the first end; and a mounting bracket configured to be attached to the vertical portion of the pole, the first end configured to slide over the mounting bracket to secure the housing to the pole, wherein the mounting bracket comprises:

a base plate;

a catch arm extending obliquely outwardly from the top of the base plate; and a fastening arm extending obliquely outwardly from the bottom of the base plate to mate with a fastener for securing the housing to the mounting bracket;

wherein the mounting bracket attaches to an exterior of the housing.

2. The light fixture according to claim 1, wherein:

each light emitting diode includes an optic to selectively distribute the light from a respective diode, wherein a first set of optics on a first set of diodes produce a first distribution, and a second set of optics on a second set of diodes produces a second, different distribution.

3. The light fixture according to claim 1, wherein the illuminating compartment includes a top wall defined by the housing;

wherein the plurality of light emitting diodes are arrayed on a circuit board; and wherein the circuit board is mounted to the top wall via thermal glue or thermal grease.

4. The light fixture according to claim 1, wherein the mounting bracket further comprises:

a pair of positioning flanges extending outwardly from the side of the base plate for centering the housing with respect to the mounting bracket.

5. The light fixture according to claim 1, further comprising:

a mounting adaptor, the mounting adaptor attached to the first end to connect the housing to the mounting bracket, the adaptor comprising an end wall substantially matching the cross section of the pole.

6. The light fixture according to claim 1, wherein the door provides access to the wiring compartment and not the illuminating compartment.

7. An LED light fixture comprising:

an integrally formed unitary housing having a first portion and second portion laterally adjacent to one another, the first and second portions at least partially defining separate illuminating and wiring compartments;

the illuminating compartment at least partially contains: a plurality of light emitting diodes; and a reflector, the illuminating compartment being partially defined by a frame and a lens mounted to the first portion of the housing;

the second portion of the housing having an elongated body with a first end opposite the first portion and a second end joining with the first portion, the second portion providing a mounting arm for mounting the light fixture to a vertical portion of a pole at the first end; and a mounting bracket configured to be attached to the vertical portion of the pole, the first end configured to slide over the mounting bracket to secure the housing to the pole, wherein the mounting bracket comprises:

a base plate;

a catch arm extending obliquely outwardly from the top of the base plate; and a fastening arm extending obliquely outwardly from the bottom of the base plate to mate with a fastener for securing the housing to the mounting bracket;

wherein the mounting bracket attaches to an exterior of the housing.

8. The light fixture according to claim 7, wherein the mounting bracket further comprises:

a pair of positioning flanges extending outwardly from the side of the base plate for centering the housing with respect to the mounting bracket.

9. The light fixture according to claim 7, further comprising:

a mounting adaptor, the mounting adaptor attached to the first end to connect the housing to the mounting bracket, the adaptor comprising an end profile substantially matching the cross section of the pole.

10. The light fixture according to claim 7, wherein:

the wiring compartment has at least one wall defined by a door, the door being pivotably attached to the housing; and a driver for the plurality of light emitting diodes, the driver being mounted to the door and configured to be received in the wiring compartment of the housing.

11. The light fixture according to claim 10, wherein the door provides access to the wiring compartment and not the illuminating compartment.

12. The light fixture according to claim 7, wherein:

each light emitting diode includes an optic to selectively distribute the light from a respective diode, wherein a first set of optics on a first set of diodes produce a first distribution, and a second set of optics on a second set of diodes produces a second, different distribution.

13. The light fixture according to claim 7, wherein the illuminating compartment includes a top wall defined by the housing;

wherein the plurality of light emitting diodes are arrayed on a circuit board; and wherein the circuit board is mounted to the top wall via thermal glue or thermal grease.

14. A method of installing a light fixture to a pole, comprising:

providing an LED light fixture comprising:

an integrally formed unitary housing having a first portion and second portion laterally adjacent to one another, the first and second portions at least partially defining separate illuminating and wiring compartments;

the illuminating compartment at least partially contains:

a plurality of light emitting diodes; and a reflector, the illuminating compartment being partially defined by a frame and a lens mounted to the first portion of the housing;

the second portion of the housing having an elongated body with a first end distal from the first portion and a second end joining with the first portion, the second portion providing a mounting arm for mounting the light fixture to a pole at the first end; and mounting a bracket to a vertical portion of the pole at a desired height, the mounting bracket comprising:

a base plate;

a catch arm extending obliquely outwardly from the top of the base plate; and a fastening arm extending obliquely outwardly from the bottom of the base plate;

sliding the first end of the housing vertically downward over the mounting bracket until the first end engages the catch arm, such that the mounting bracket attaches to an exterior of the housing, and fastening the housing to the bracket by engaging a set screw with the fastening arm.

15. The method according to claim 14, further comprising:

mounting an adaptor to the first end, wherein the step of sliding the first end comprises sliding the first end with the adaptor over the mounting bracket.

16. The method according to claim 14, wherein the wiring compartment has at least one wall defined by a door, the door being pivotably attached to the housing and a driver for the plurality of light emitting diodes is mounted to the door, the method further comprising:

electrically connecting source wires from within the pole to the driver when the door is open; and closing the door to complete installation.

17. The method according to claim 14, wherein the fixture is installed without accessing an interior of the illuminating compartment.

* * * * *